United States Patent [19]

Gustafsson

[11] 4,166,305

[45] Sep. 4, 1979

[54] DEVICE FOR WASHING MACHINE PARTS

[75] Inventor: Berth U. Gustafsson, Österskär, Sweden

[73] Assignee: Projectus Industriprodukter Aktiebolag, Bromma, Sweden

[21] Appl. No.: 859,138

[22] Filed: Dec. 9, 1977

[30] Foreign Application Priority Data

Dec. 10, 1976 [SE] Sweden ..... 7613928

[51] Int. Cl.[2] ..... B08B 3/02; B08B 3/08; B08B 3/10; B08B 7/04

[52] U.S. Cl. ..... 15/302; 134/10; 134/30; 134/34; 134/40; 134/61; 134/63; 134/199

[58] Field of Search ..... 134/34, 40, 25 R, 1, 134/10, 198, 199, 63, 88, 30; 209/211; 15/302

[56] References Cited

U.S. PATENT DOCUMENTS

| | | | |
|---|---|---|---|
| 1,056,318 | 3/1913 | Bruck | 209/211 X |
| 2,625,945 | 1/1953 | Secor | 134/199 |
| 2,726,766 | 12/1955 | Rakowsky | 209/211 |
| 2,985,178 | 5/1961 | Christensen, Jr. | 134/199 X |
| 3,546,018 | 12/1970 | Hittel et al. | 134/1 |
| 3,965,523 | 6/1976 | Elliott | 15/302 |
| 4,073,029 | 2/1978 | Vassallo | 15/302 |

*Primary Examiner*—Richard V. Fisher

*Attorney, Agent, or Firm*—Birch, Stewart, Kolasch and Birch

[57] ABSTRACT

A device for washing machine parts, e.g. balls or rolls for roller bearings, having finely finished spherical or cylindrical outer surfaces, in connection with the manufacture thereof. The machine parts are fed one after the other through a washing chamber being axially symmetrical to the feed direction, a solvent being injected under pressure into the chamber in such a direction that the solvent flows with a rotational velocity component around the feed direction and strikes the finely worked surfaces of the machine part at a small angle but with great power, whereby contaminants being soluble in the solvent as well as other contaminants being bound to the surface are effectively removed therefrom.

10 Claims, 6 Drawing Figures

DEVICE FOR WASHING MACHINE PARTS

BACKGROUND OF THE INVENTION

The present invention relates to a method and a device for washing machine parts having machine-finished spherical or cylindrical outer surfaces, e.g. balls or rolls for roller bearings, in connection with the manufacture thereof.

In the manufacture of roller bearings, washing, i.e. cleaning and degreasing, should be effected upon each finishing operation in order to prevent the transfer of dirt and finishing remainders from one operation to another. Moreover, one operation is often completed by a dimensional check or a surface inspection, which calls for clean surfaces to provide correct results.

The manufacture of rolls and balls is often performed in such a way that the parts have to be stored for a long time, and to avoid damage to the surface finish, rust protection is required. For a satisfactory rust protection a rust preventive has to be applied onto completely clean surfaces.

To obtain a perfect operation of the finished roller bearing, the balls or rolls have to be machined to an extremely high surface finish.

Thus, it is absolutely necessary to protect the washing goods against damage during the washing operation, e.g. by preventing the balls or rolls from hitting each other or other objects so as to cause damage to the finished surfaces. Therefore, during the washing operation, a certain minimum distance should be maintained between the parts to avoid surface damage.

By experience in the art of roller bearings, it has been found that the washing must result in a residual dirt content on the surfaces of less than 0.01 mg per $cm^2$ of the bearing surface. Such a result is to be considered as a minimum requirement and, in continuous service, it must be even better irrespective of the condition of the parts before the washing operation.

The requirements of the washing method depend heavily on the preceding operation, e.g. turning, grinding, lapping or polishing. Likewise, the washing method and washing results are dependent on the surface quality (profile depth) of the washing goods.

Regarding the choice of solvents for the washing operation, requirements for an increased environmental and personal health protection have caused the water-based washing methods to be abandoned, since it is no longer permitted to discharge the used washing liquid directly into open water and, additionally the destruction or regeneration is highly energy consuming and costly. Furthermore, chlorinated hydrocarbons, such as tri- and perchloroethylene, must be avoided if possible, since they are suspected to cause cancer. Moreover, efforts are made to avoid freons which, as a matter of fact, are prohibited in certain states in the U.S.A., because of their effect upon the ozone layer surrounding the earth.

In view of the above-mentioned, it is desireable to provide a washing method which, on the one hand, is effective to such a degree that also other solvents, such as white spirit or the like, having per se a lower washing power, can be used with a satisfactory result, and, on the other hand, permits the use of solvents, which are per se, polluting or involving personal health risks, such as the above-mentioned chlorinated hydrocarbons and freons, by closed re-circulation of such solvents.

SUMMARY OF THE INVENTION

Both requirements will be fulfilled by the method and the device according to the present invention, which calls for the injection of solvent under pressure into a preferably cylindrical washing chamber, through which the machine parts are fed one after the other and wherein the washing liquid forms a steady, rotating flow. Consequently, the washing liquid dissolves cutting oils, polishing waxes, cooling agents, lapping abrasives or the like which are present on the surface of the machine part. Moreover, the injected liquid will strike the finished surface at a small angle and mechanically knock away solid particles left on the surface from a preceding working operation.

Such solid particles may consist of steel particles from grinding and polishing processes or particles from e.g. grinding discs.

Four kinds of material bonding will occur in this case, namely cohesion, adhesion, adsorption and magnetic bonding. Cohesion is the bond caused by molecular forces in e.g. a liquid such as a lubricating oil, whereas adhesion is the result of forces between the basic material and other solid particles. Absorption is either physical, e.g. when wetting a surface, or chemical, e.g. when pickling the same, the surface of the basic material being transformed while participating in a chemical reaction with the applied liquid.

In this connection, magnetic bonding appears between magnetic particles and the basic material. During a grinding or polishing operation the cutting pressure will cause a uniform orientation of the elementary magnets in the surface of the basic material, which will thus be magnetized even after the finishing operation. This magnetism is sufficient for retaining particles at the surface, even if the oil film is totally removed by means of a solvent, e.g. in a bath.

Thus, a common mistake in previously known methods of degreasing has been to remove the oil and grease film from the surface of the workpiece, while letting practically all solid particles remain on the surface after the degreasing operation. Moreover, it has been established that the bond between the solid particles and the basic material is stronger after the degreasing operation than before the same. Probably, a more effective molecular bonding occurs due to the increasing adhesive forces when removing the oil film.

By feeding the solvent in the form of a jet striking relatively hard onto the surface, the basic material will also be mechanically worked, thereby eliminating the adhesive forces already present in connection with the first supply of solvent, i.e. at the first possible instance.

Apart from the removal of adhesively bound particles by such injection of the solvent, the magnetically bound particles can be removed by applying an alternating magnetic field immediately before or during the washing operation.

Thus the present invention enables a very effective degreasing and cleaning of the finished surfaces of the machine parts so that also white spirit can be used in spite of its inferior washing power as compared to the above-mentioned washing liquids. No toxic effect of white spirit has been discovered and, furthermore, it is easily accessible, inexpensive and easy to dispose of after use, e.g. by burning while making use of its energy contents, e.g. in a heating boiler.

By drying the machine parts by means of hot air in the same cylindrical chamber and maintaining a reduced pressure in the chamber, it is even possible to use more risky, but also more effective washing liquids, such as chlorinated hydrocarbons or freons, which are preferably recirculated and reused to an unlimited extent by way of energy-saving distillation. Of course, this requires a totally closed and sealed system.

A further advantage of the present invention is that the rotating washing liquid, by proper design and positioning of the solvent injecting and draining means, can form a protective film on the inner surface of the chamber wall and thereby protect the finished, fragile surfaces of the machine parts from being damaged when ramming into the chamber walls. Further, the motion of the machine parts through the chamber can be controlled by the liquid flow. Thus, by directing the injection nozzles at an angle inclined towards the feed direction of the machine parts, the feed rate can be controlled by varying the liquid pressure and, moreover, balls or other spherical parts can be rotated around different axes, so that the washing becomes effective over the whole surface.

Other features and advantages of the invention will appear from the following description, the claims and the drawings.

BRIEF DESCRIPTION OF THE DRAWINGS

The invention will be described further below with reference to the accompanying drawings illustrating a preferred, non-limiting embodiment of the inventive device.

DESCRIPTION OF AN EXEMPLARY EMBODIMENT

Figure 1A:
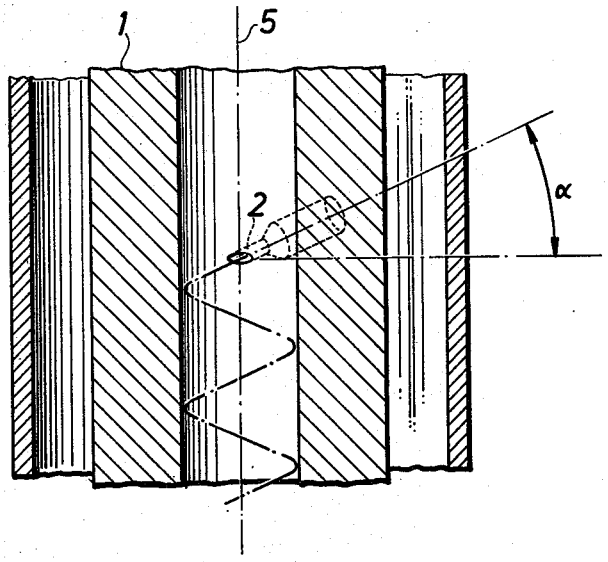
FIGS. 1*a* and 1*b* illustrate the basic inventive concept and show in longitudinal and cross sectional views, respectively, a portion of a cylindrical tube enclosed in a casing for pressurized liquid, which is injected via a tangentially directed nozzle onto a ball or roll in the tube.
Figure 1B:
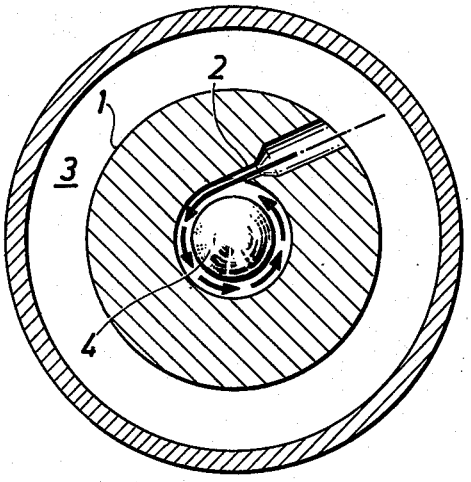

FIG. 1*a* or 1*b* shows a cylindrical tube 1 having a tangentially directed nozzle 2 for the injection of a pressurized washing liquid from a casing chamber 3 enclosing the tube 1. The washing liquid flows helically in the tube 1, i.e. with a rotational as well as an axial component. A machine part such as a ball or a roll 4 disposed in the tube, influenced by the rotational flow of the liquid, thereby causing a shearing force between the liquid and the surface of the ball or roll, said force being proportional to the liquid rotational flow rate.

The axial flow of the liquid causes the ball or roll to travel through the tube at a controlled speed. The ball is additionally brought to rotate around an axis lying in a plane normal to the feed direction by the influence of the axial component of the liquid flow and, therefore, the total surface of the ball will be exposed to the strong liquid flow and, consequently, will be freed from liquid and particulate contaminants.

Because of the relatively high speed of the injected liquid, a stable liquid film is created at the inner surface of the tube wall, thus preventing the balls or rolls from hitting the tube wall in metal-to-metal contact therewith. This would cause damage to the finished spherical or cylindrical surface. The angle $\alpha$ of the injection nozzle 2 to a plane normal to the feed direction (i.e. the tube axis 5) is in order of the 10 to 80 degrees, preferably about 30 degrees. However, depending on the desired feed rate of the machine parts and the required liquid pressure, the angle can be adjusted to a suitable value in each specific case. Likewise, the clearance of the machine parts to the inner wall surface of the tube can be chosen with regard to the particular circumstances.

Figure 2:
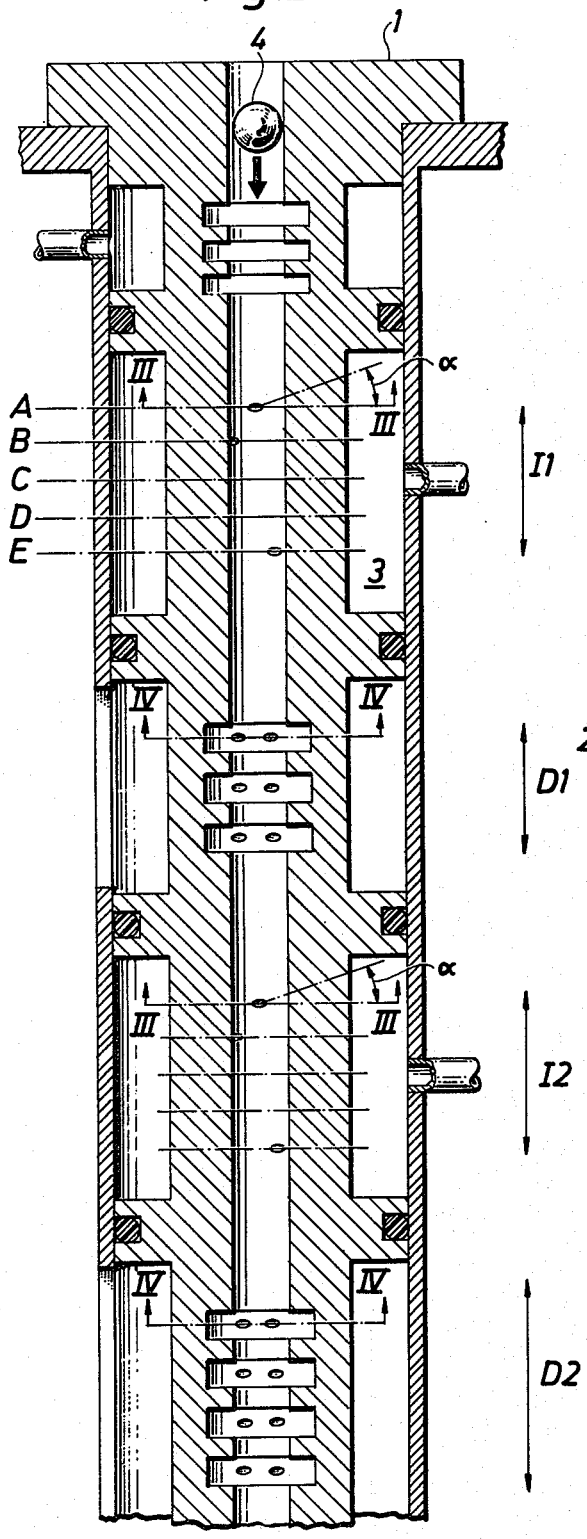
FIG. 2 is a longitudinal section through a longer portion of a cylindrical tube serving as a washing chamber and having a number of injection and draining openings for the washing liquid.
Figure 3:
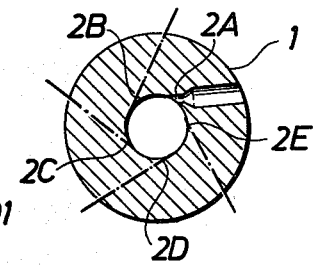
FIG. 3 and 4 are cross sections taken along the lines III—III and IV—IV, respectively, in FIG. 2.
Figure 4:
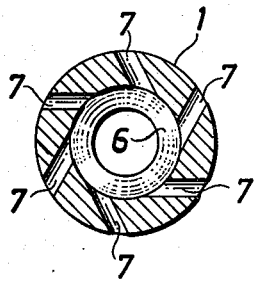

FIG. 2 shows a longer tube portion having a first injection section I1, wherein a number, in this case five, liquid inlet nozzles 2, positioned at location A–E, are successively distributed axially and circumferentially around the tube 1 (compare FIG. 3) so as to cause a helical liquid flow and a good washing effect. After these five nozzles 2A–E a draining section D1 having, e.g., three successive draining grooves 6 is provided. The draining section is needed to secure an effective washing. These grooves have outlet holes 7 oriented in an opposite direction as compared to the inlet nozzles 2A–E. If the liquid still has sufficient rotational energy when reaching the draining grooves, the liquid will be directed out through the outlet holes 7 by the centrifugal force. In this way, a fast and total draining of the injected washing liquid is obtained in the draining section D1. As apparent from FIG. 5, there is also a demagnetizing coil 16 positioned immediately before the first washing portion. The coil generates an alternating, gradually decreasing magnetic field, which demagnetizes the ball and the adhesively bound particles so as to reduce the remaining magnetism to a minimum when the first washing portion is reached. Thus, also magnetically bound particles are effectively removed in the first washing portion I1, D1.

In series with the first washing portion I1, D1 there is a corresponding, final washing portion I2, D2. The washing is preferably performed while letting the liquid flow in a counter-direction between the two washing portions, i.e. the dirty balls or rolls run into a non-purified washing liquid in the first washing portion, the washing liquid preferably being re-circulated from the final washing portion, whereas in the second washing portion they run into a clean, possibly distillated washing liquid for effecting the final washing. The second drain section D2 is provided with a number of, drain grooves 6 e.g., four in number, having corresponding outlet holes 7 for the washing liquid.

The device as described above with reference to FIG. 2 is sufficiently effective for the use of white spirit as washing liquid. In this case, the balls or rolls can leave the washing apparatus in a wet condition suitable for subsequent measurements, surface inspection or coating with rust-preventive oil.

Figure 5:
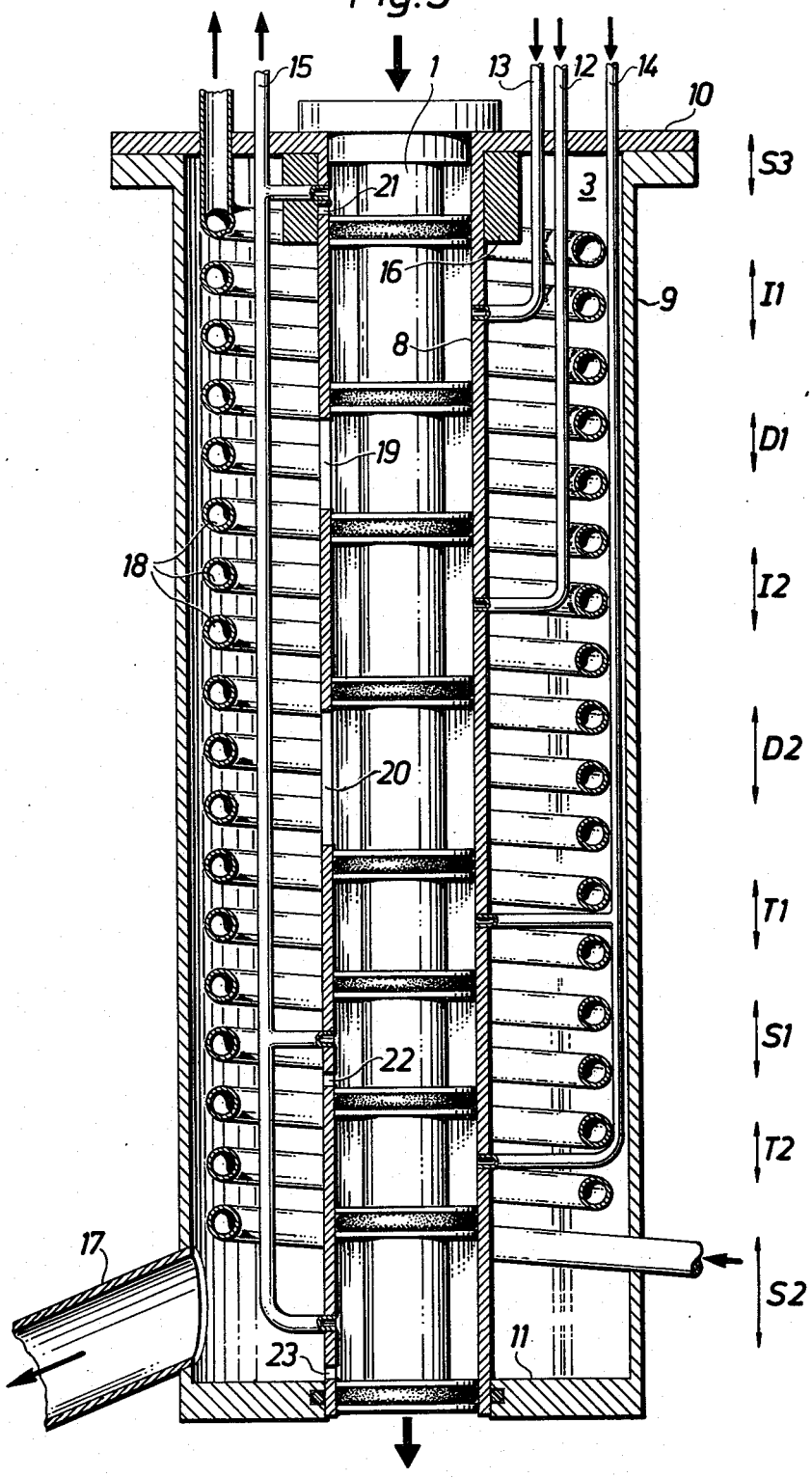
FIG. 5 is a longitudinal section of a preferred embodiment of an inventive device in its entirety.

In case white spirits will not produce a satisfactory washing result or if the balls have to be dried after the washing operation, the apparatus shown in FIG. 5 can be used. The upper part of this apparatus is identical to the one shown in FIG. 2, except for an outer casing 9 outside the casing 8, upper and lower end flanges 10 and 11, connection conduits 12–15 for pure and re-circulated washing liquid (12 and 13, respectively), for dry air (14) and exhausted air (15), the above-mentioned coil 16 for generating an alternating magnetic field, a lower discharge conduit 17 for used washing liquid as well as a refrigeration coil 18 arranged between the casings 8 and 9.

The apparatus according to FIG. 5 is intended for distillable washing liquids such as tri- and perchloroethylene or freons. The apparatus contains, counted from above, an air sluice S3, the above described first washing portion including its injection and drain sections I1, D1, the likewise above-mentioned second washing portion with its injection and drain sections I2, D2, a section T1 for the injection of dry air, an outlet section S1 for the dry air, a second air injection section T2 and an air sluice S2. The apparatus is made gas-proof, and the refrigeration coil 18 inside the closure 8–11 will reduce the vapor pressure in the apparatus so as to minimize the risk of leakage of solvent vapor. The dry air is preferably re-circulated as described in the U.S. Patent Application Ser. No. 859,140.

Thus, the machine parts are successively fed through the upper inlet, wherein they are first exposed to the alternating magnetic field generated by the coil 16 by means of an alternating current, e.g. of the frequency 50 Hz, thereby demagnetizing the machine parts and the magnetically bound steel particles. Thereafter, the machine parts enter the injection section I1, where a first washing is effected so as to remove oils, etc. soluble in the washing liquid as well as adhesively and magnetically bound particles.

The washing liquid containing such contaminants escapes through the outlet holes 7 in the drain section D1 and flows via an opening 19 in the inner casing 8 outwardly into the enclosing casing chamber 3 and then via a discharge conduit 17 to a collecting tank (not shown). From this tank the washing liquid, upon being filtered or the like, can be re-circulated or pumped under pressure via the conduit 13 into the injection section I1. The coarsely washed machine part now reaches the injection section I2 in the final washing portion, where they are finely washed in the pure washing liquid delivered via the conduit 12. In case of white spirit or the like fresh liquid is used, whereas, in case of tri- or perchloroethylene or freons, the pure washing liquid suitably consists of a distillate obtained by distillation of liquid from the collecting tank. In the same way as in the preceding washing portion, the washing liquid is drained in the drain section S2 and escapes via an opening 20 in the inner casing 8 into the discharge conduit 17 and the collecting tank.

In order to subsequently dry the machine part, the latter enters into two drying sections T1, T2, where dry hot air is injected through nozzles in the tube wall. In the respective air exhaust sections S1–S3 being connected to the suction side of a compressor or the like via the conduit 15, the air, which now contains solvent vapor, is exhausted and, moreover, a reduced pressure is thereby maintained within the tube 1 and within the enclosing casing chamber 3 (compare the openings 21–23 in the tube wall 8). Since additionally the temperature is kept low by means of the refrigeration coil 18, the partial pressure of the solvent is also reduced, and the risk of solvent leakage to the environment is minimized. As mentioned above, this is of great importance in case enviromentally harmful washing liquids are used.

As stated above, the apparatus may include only the upper part containing the two washing portions (according to FIG. 2) and the demagnetizing coil 16, in case white spirit is used and the machine parts shall leave the apparatus in a wet condition.

In practice, it may be advantageous to mount the apparatus at a somewhat inclined angle, such as 10 to 45 degrees, preferably 30 degrees, relative to the vertical direction, so that washing liquid possibly dripping from the injection nozzles 2A–E is safely collected by the draining grooves 6 in the respective draining section D1, D2.

In industrial applications, particularly in the manufacture of roller bearings, a plurality of apparatus units according to FIG. 5 are suitably mounted for parallel operation.

Finally it should be pointed out that a number of modifications and detail changes can be made by those skilled in the art within the scope of the inventive idea defined in the claims. Thus, if desired, the rotational direction of the injected solvent can be reversed in successive washing portions, particularly if a ball or a roll has the tendency to rotate at a rotational speed close to that of the flowing solvent, which would give a substantially lower velocity gradient between the liquid flow and the ball or roll, and thus a reduced washing effect.

I claim:

1. An improved device for washing machine parts having finely worked external surfaces, comprising a treatment chamber disposed axially and symmetrically to an imaginary axis and having at the axial ends thereof an inlet and an outlet for introducing and removing said machine parts one after the other, at least one injection nozzle being provided for the injection of a solvent into the treatment chamber, under pressure, said nozzle being disposed at the treatment chamber wall in a washing portion of said treatment chamber adjacent the inlet thereof and being directed substantially tangentially along said wall as seen in a plane normal to said imaginary axis so as to cause a rotational flow of said solvent, and a draining section disposed in said washing portion between said injection nozzle and subsequent additional treatment portions of said treatment chamber, said draining section including at least one substantially annular draining groove formed in the chamber wall, and means defining outlet openings for the rotationally flowing solvent being disposed in said groove and being directed substantially tangentially so as to align with the flow direction of said solvent.

2. The device as defined in claim 1, wherein said nozzle is inclined in relationship to said plane, so that the injection direction is oriented at an angle to said plane.

3. The device as defined in claim 1, wherein a plurality of nozzles is disposed along a helical path around said axis.

4. The device as defined in claim 1, wherein a plurality of outlet hole defining means is circumferentially distributed in said annular groove.

5. The device as defined in claim 1, wherein at least two annular grooves and corresponding outlet hole defining means are disposed axially one after the other.

6. The device as defined in claim 1, wherein at least one additional washing portion is disposed between said draining section and said outlet of the treatment chamber.

7. The device as defined in claim 6, wherein at least two sets of injection nozzles and at least two draining grooves are provided in each washing portion.

8. The device as defined in claim 1, wherein means are provided for generating an alternating magnetic field in the treatment chamber between the inlet thereof and said injection nozzle.

9. The device as defined in claim 1, wherein the treatment chamber is formed by a tube.

10. The device as defined in claim 1, wherein at least one washing portion is followed by at least one drying portion, the latter including means for injecting dry air into the treatment chamber means and for draining said air therefrom.

* * * * *